US007828383B1

(12) United States Patent
Urbanek et al.

(10) Patent No.: US 7,828,383 B1
(45) Date of Patent: Nov. 9, 2010

(54) ROTATING SEATING SYSTEM FOR MARINE VESSEL

(75) Inventors: Justin James Urbanek, Cape Canaveral, FL (US); John W. Hamilton, Mims, FL (US); Michael Dru Merry, Fayetteville, GA (US)

(73) Assignee: Brunswick Corporation, Lake Forest, IL (US)

( * ) Notice: Subject to any disclaimer, the term of this patent is extended or adjusted under 35 U.S.C. 154(b) by 192 days.

(21) Appl. No.: 12/028,184

(22) Filed: Feb. 8, 2008

Related U.S. Application Data

(60) Provisional application No. 60/889,855, filed on Feb. 14, 2007.

(51) Int. Cl.
*A47C 1/032* (2006.01)

(52) U.S. Cl. ..... 297/344.1; 297/344.26; 296/65.06; 114/194; 248/430

(58) Field of Classification Search ..... 297/344.21, 297/344.22, 344.26, 344.1; 296/65.06, 65.07, 296/64; 114/188, 194; 248/430
See application file for complete search history.

(56) References Cited

U.S. PATENT DOCUMENTS 3,151,910 A 10/1964 Larson
4,184,656 A * 1/1980 Wakeley ..... 297/344.1 X
4,352,218 A 10/1982 Lundberg
4,709,649 A 12/1987 Wann
4,722,706 A 2/1988 Young
4,854,261 A 8/1989 Goldsmith
5,318,340 A 6/1994 Henry
5,799,605 A 9/1998 Huse
6,352,047 B1 3/2002 Bogniard
6,883,458 B2 4/2005 Huse
7,131,699 B2 11/2006 Mulmed

FOREIGN PATENT DOCUMENTS

GB 2060363 A * 5/1981

* cited by examiner

*Primary Examiner*—Anthony D Barfield
(74) *Attorney, Agent, or Firm*—Malin Haley DiMaggio Bowen & Lhota, P.A.

(57) ABSTRACT

A rotating seating assembly for use in marine vessels. The seat assembly includes a car and track assembly with moveable sections. The sections can move about curvilinear paths which are defined by the curved track segments. A unique bearing/track linkage mechanism, interlocking the component parts, is incorporated into the novel design. In one configuration, the seating sections rotate about a circle track, a full 360 degrees. Bearing assemblies and rolling mechanisms provide smooth, quiet and efficient operation of the system.

12 Claims, 7 Drawing Sheets

ROTATING SEATING SYSTEM FOR MARINE VESSEL

BACKGROUND OF THE INVENTION

1. Field of the Invention

The present invention generally relates to seats on a boat, and more particularly, a rotating seating system. The system can be incorporated into cockpit seating, or other areas within or upon the vessels, wherein the seat components are moveable about arcuate or curvilinear tracks or channel members. A range of movement is provided, along with locking mechanisms.

2. Description of Related Art

Boat designs have included a variety of seating arrangements and designs for the user. Specifically, there are many different designs for seats located within a boat, especially for open topped boats commonly used for day trips of limited duration. In addition, these seats provide the user with a variety of positions in which to sit. Due to the limited space within a boat, these different positions must be operable within small parameters. Often modern boats have seats which are rigidly fixed and can only change from providing an upright position to providing a reclining position, but the user's legs are left without support. Other designs provide the ability to recline, but with cumbersome parts and uncomfortable ergonomics. Further, users of boats often desire to stretch out or relax in comfort but because of the limited space provided on the seat of a boat, this is either impossible or uncomfortable.

Although prior designs have sought to improve the structure, operation, and utility of seats on marine vehicles, existing designs have failed to adequately address moveable seating systems which maximize space, and which allow for rotating seating or movement of individual seating sections about curved paths. The designs of the instant invention also allow for maximizing the use of limited spaces and areas onboard, as well as provide a cost effective and efficient system. As the interior designs for sport boats, cruisers and yachts develop with high end, luxurious, exotic, custom designed and expensive entertainment and living quarters, and the associated furnishings required, the instant invention fulfills an unresolved need.

The prior art reveals a number of attempts directed toward improving seats on marine vehicles, including changing position between upright and reclined states. For example, U.S. Pat. No. 6,883,458 issued to Huse discloses a FOLD-DOWN SEAT CONSTRUCTION. Huse discloses a boat seat assembly in which two seats are created by four panels connected to each other by three hinges, and slides between a two-seat back to back structure and an elongated surface.

U.S. Pat. No. 5,799,605 issued to Huse discloses an EXPANDABLE BOAT SEAT. Huse discloses a boat seat assembly which expands the length of the seat by sliding the frame of the seat inward and outward from the base of the seat.

U.S. Pat. No. 4,854,261 issued to Goldsmith discloses a COMBINATION SEAT FOR BOATS. Goldsmith discloses a combination of seats which face back to back and are expandable to form a surface on which a single user can recline. Further, Goldsmith discloses a provision for a galley and a sink underneath the seat combinations, but does not address the problems addressed by the instant invention.

As has been described, the prior art does not address, or overcome, the problems with moveable or rotating seat assembly. Accordingly, what is needed is an assembly which allows the seats to rotate or revolve in curvilinear fashion. In one embodiment, the seats rotate along and upon tracks in a circular motion, 360 degrees. The seat can be positioned incrementally, and locked in place where desired. It is therefore, to the effective resolution of the aforementioned problems and shortcomings of the prior art that the present invention is directed. However, in view of the boat seat designs in existence at the time the present invention was completed, it was not obvious to those persons of ordinary skill in the pertinent art and marine industry as to how the identified needs could be fulfilled.

SUMMARY OF THE INVENTION

The present invention provides inventive subject matter which overcomes the above described problems. The present invention contemplates a boat seat assembly that can move about curved paths, and in a primary embodiment can rotate about a center position in a generally circular motion, if desired a full 360 degrees. The system can be comprised of individual seat segments or cars, which ride along the track.

The seating assembly is mounted about a unique track system, and secured to the vessel deck areas. The system comprises a car and track assembly, with extruded metal or composite plastic components. Bearings are incorporated into the car assembly for smooth, quiet and efficient operation.

These and other objects, advantages, and features of this invention will become clear as this description proceeds hereinafter. The invention accordingly comprises the features of construction, manufacturing methods, engineering designs and components, the interrelationship thereto, combination of elements, and arrangement of parts that will be exemplified in the description set forth hereinafter.

In accordance with these and other objects which will become apparent hereinafter, the instant invention will now be described with particular reference to the accompanying drawings.

DESCRIPTION OF PREFERRED EMBODIMENTS

Figure 1:
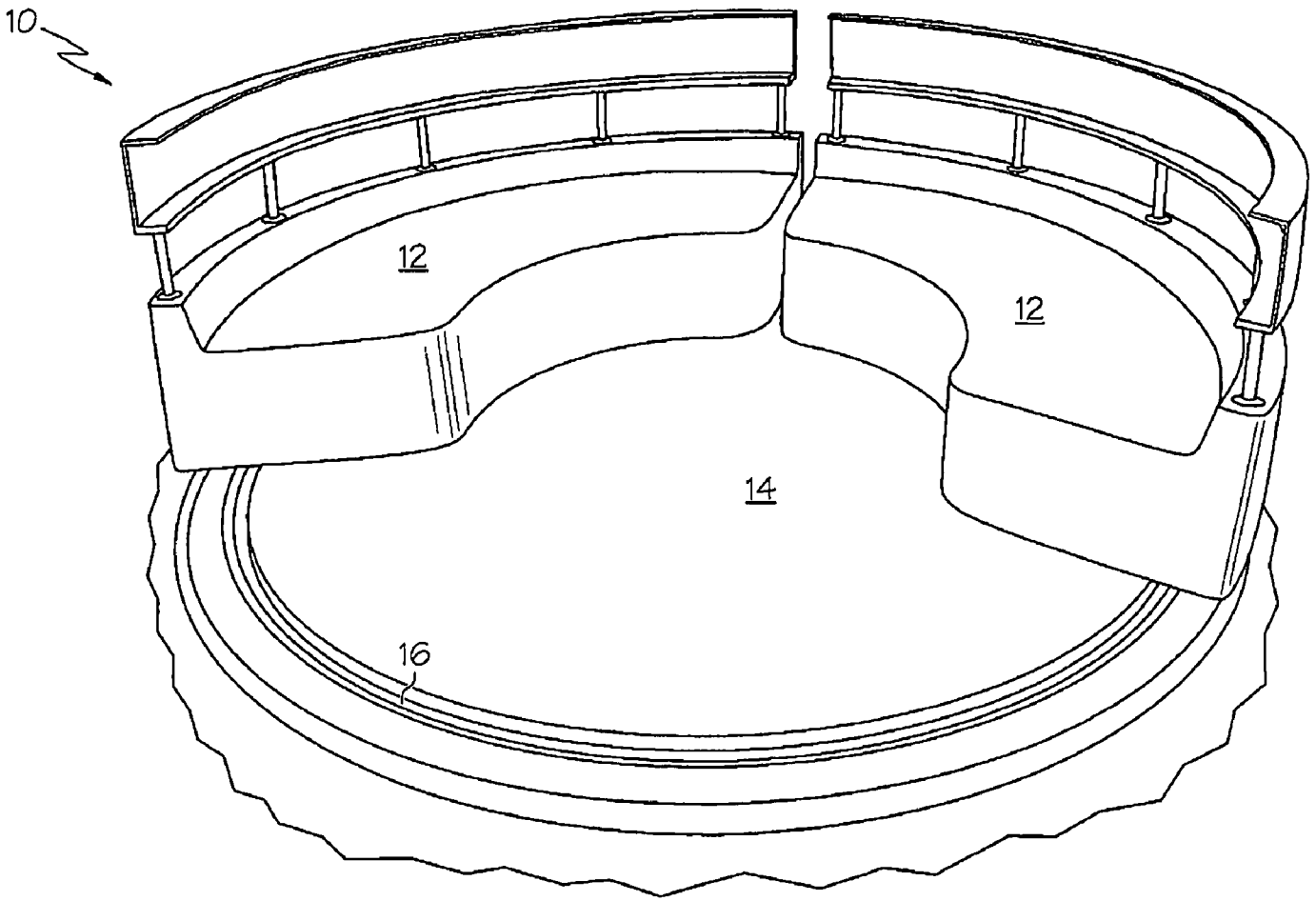
FIG. 1 is a perspective view of the seating assembly.

With reference to FIG. 1, a perspective view of the seating assembly 10 is shown. As shown, the seating assembly 10 comprises at least one seat 12, which are contemplated to be curved. As shown, the seats 12 are secured to a curved track 16 which is secured to the deck 14 of a boat. It is contemplated that the track 16 may be composed of a plurality of individual curved sections or one continuous 360 degree circular track. It is contemplated that the seats 12 are movable around the track 16, such that the seats 12 may have various positions and may face different directions on a boat deck 14. It is contemplated that the track 16 may be composed of a material such as aluminum, however, it is contemplated that one skilled in the art may use an alternate material.

Figure 2:
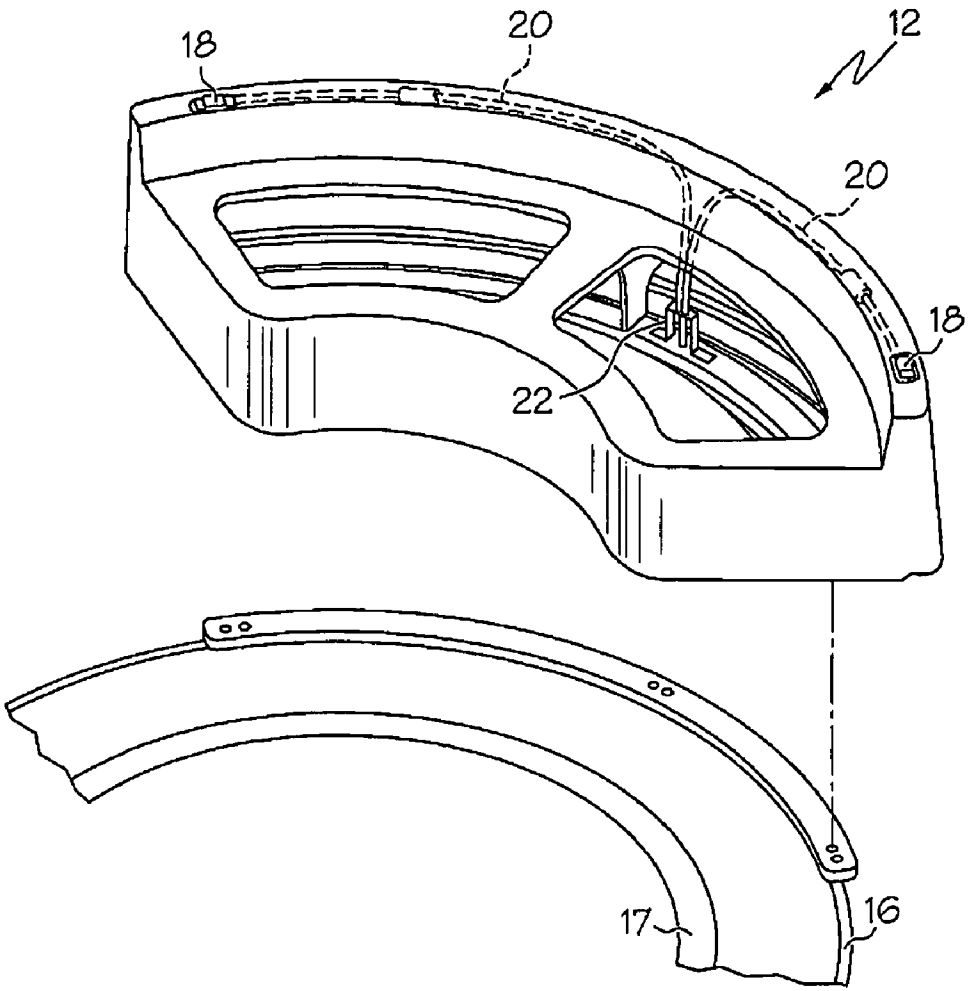
FIG. 2 is an exploded perspective view of the seat and track.

With reference to FIG. 2, an exploded perspective view of the seat 12 and track 16 is shown. As shown, seat 12 cushions have been removed from the seat 12. As shown, the seat has several handles 18 which have cables 20 extending from the handles 18. The handles 18 are located along the top of the back surface of the seats 12. The cables 20 connect with a bracket assembly 22 at the base of each seat 12. The handles 18 and cables 20 activate the locking mechanisms described below. As further shown, a track 17 for roller supports is located at the interior of the track 16.

Figure 3:
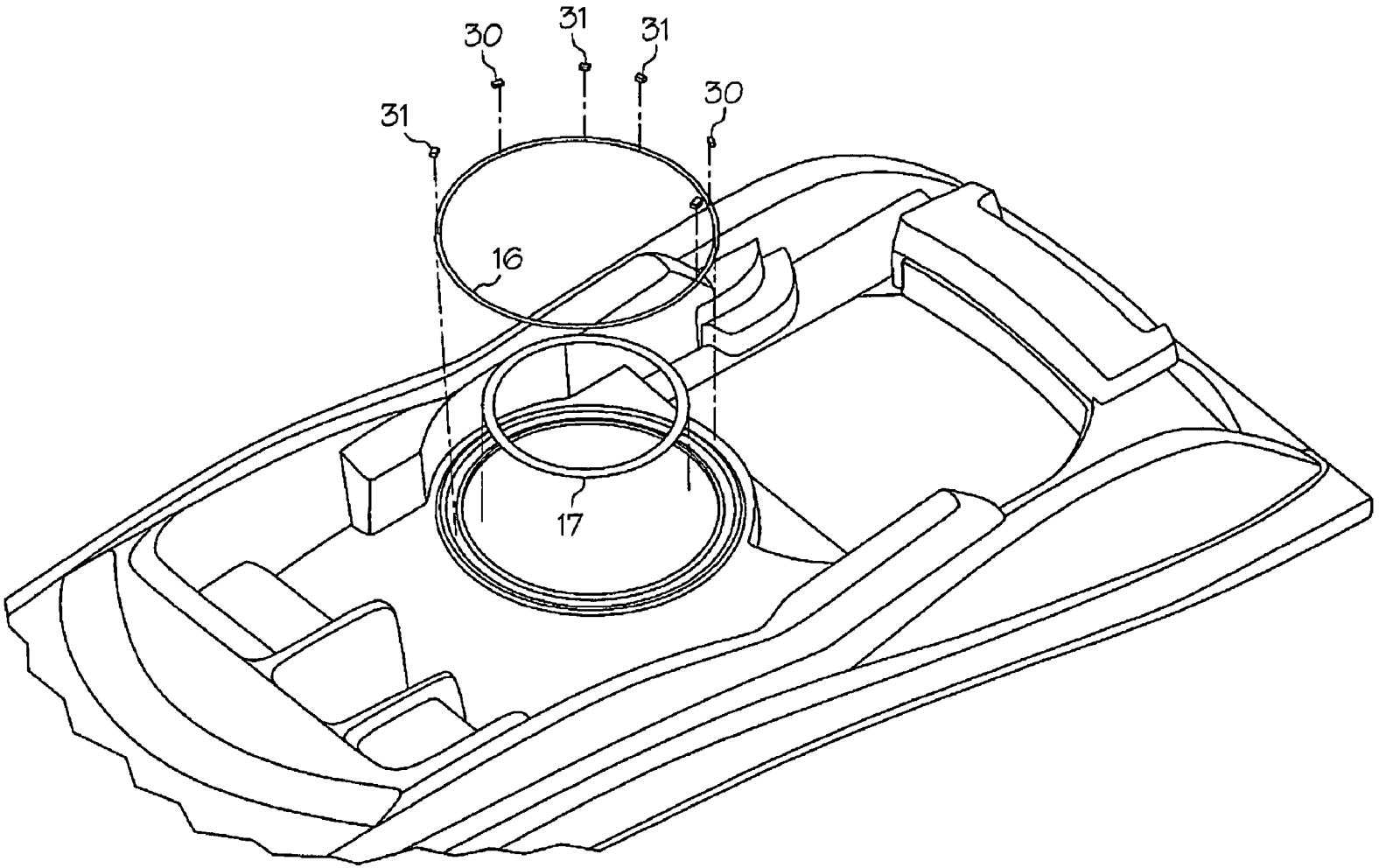
FIG. 3 is an exploded perspective view of the tracks on a boat deck.

With reference to FIG. 3, an exploded perspective view of the tracks on a boat are shown. As shown, the interior track 17 for the rolling supports is smaller than, and located interior from, the larger track 16. As shown, a plurality of lockable track cars 30 are slidingly secured to the track 16. These lockable track cars 30 and non-lockable track cars 31 are additionally secured to the base of each seat 12. The cable 20 extending from the handle 18 activates the locking mechanism in each car 30 to either hold the car 30 in place or allow the car 30 to slide along the track 16. In one embodiment, one locking car 30 and two non-locking cars 31 are utilized per each seat unit. Of course, other combinations can be incorporated into the system designs depending on area or track constraints and the like.

Figure 4:
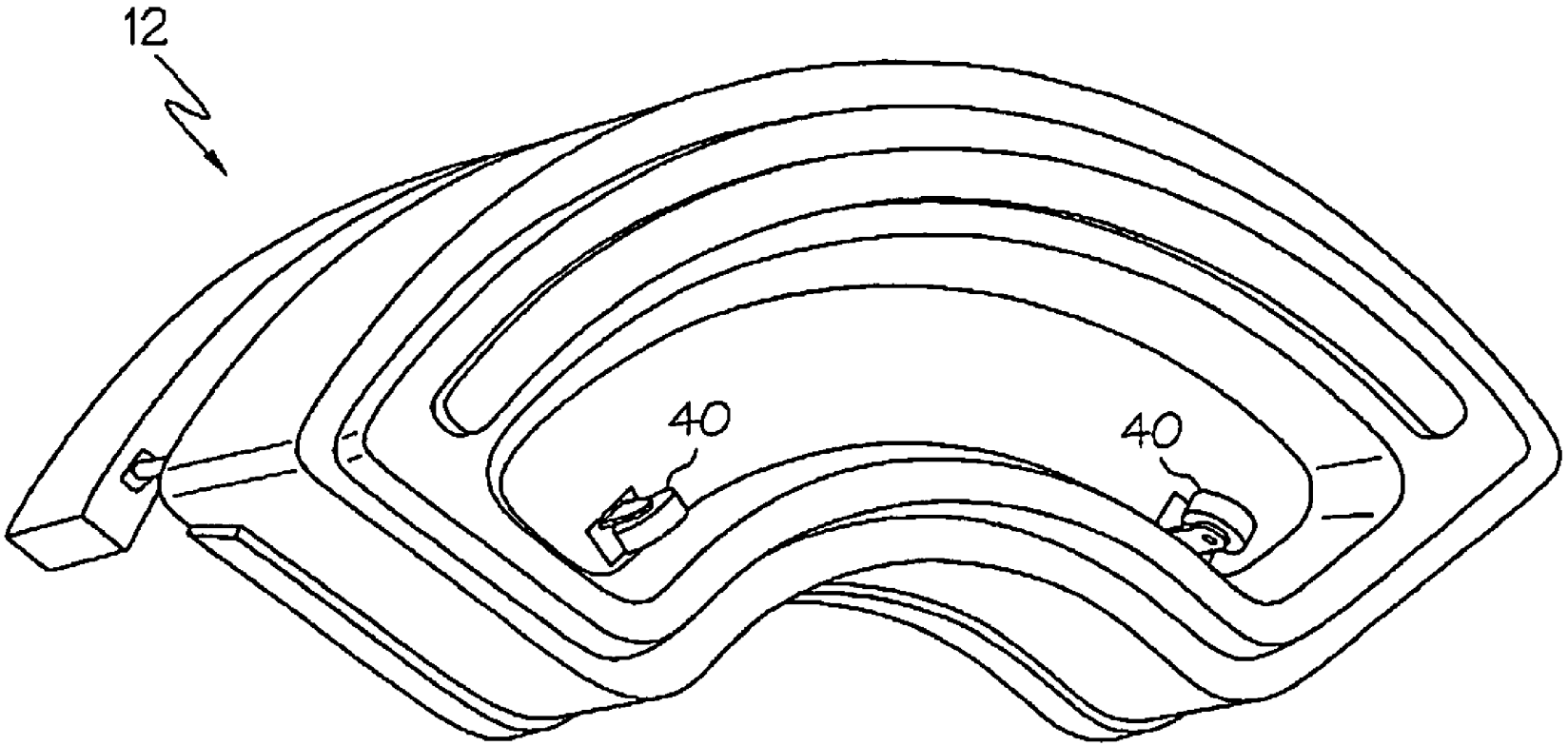
FIG. 4 is an isolated perspective view of the base of a seat.

With reference to FIG. 4, an isolated perspective view of the base of a seat 12 is shown. As shown, it is contemplated that the seat 12 will have a plurality of rolling supports 40 such as wheels, which will roll within the interior track 17. It is contemplated that the wheels 40 may be caster wheels and will be angled such that they will roll freely within the interior track 17. These wheels 40 provide support to the interior base of each seat 12.

Figure 5A:
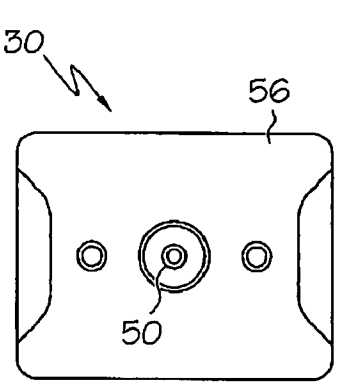
FIGS. 5A-5D show isolated views of the locking car is shown in various perspectives.
Figure 5B:
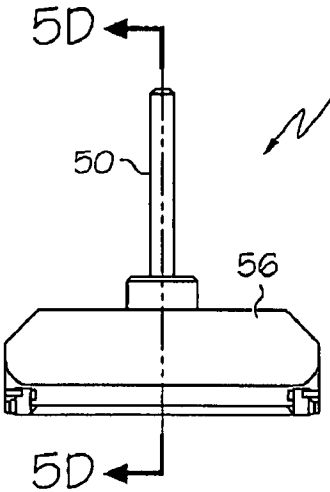
Figure 5C:
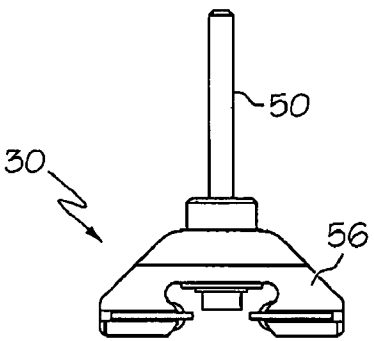
Figure 5D:
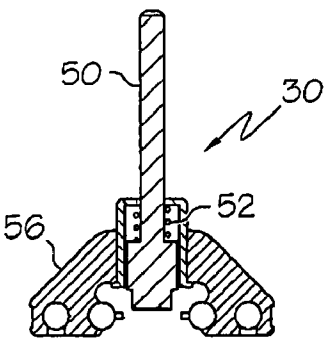

With reference to FIGS. 5A-5D, an isolated view of the locking car 30 is shown in various perspectives. FIG. 5A is a top plan view of the locking car showing the rectangular car body 56 and the upper portion of the pin stop 50. FIG. 5B is a side plan view of the car 30 showing the car body 56 and the pin stop 50. FIG. 5C is a front plan view of the car 30 showing the car body 56 and the pin stop 50. As shown, the car body 56 has a curved lower portion with cut out section shaped to receive the track 16. As shown, the lower portion of the pin stop 50 extends through the car body 56. FIG. 5D is a cross sectional view of the car 30 showing the car body 56, the pin stop 50 and a spring 52. The pin stop 50 is contemplated to move upwardly and downwardly into holes in the track 16 to act as a locking mechanism.

Figure 6A:
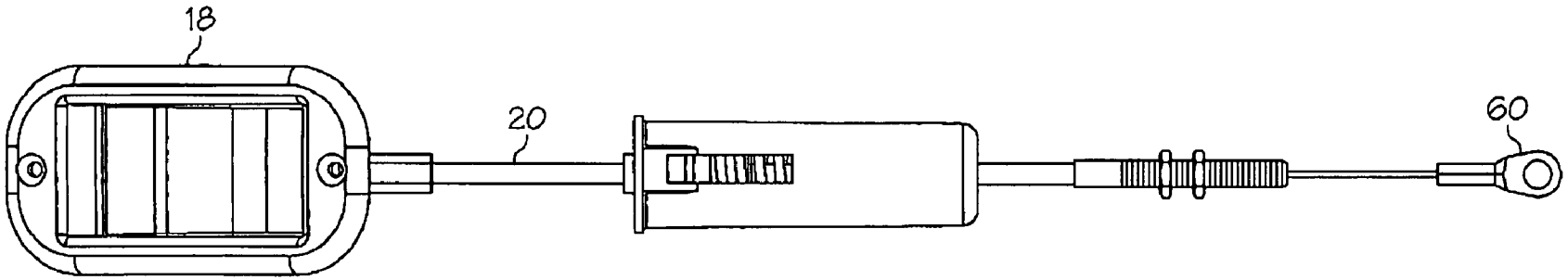
FIGS. 6A and 6B show views of the handle and cable assembly.
Figure 6B:
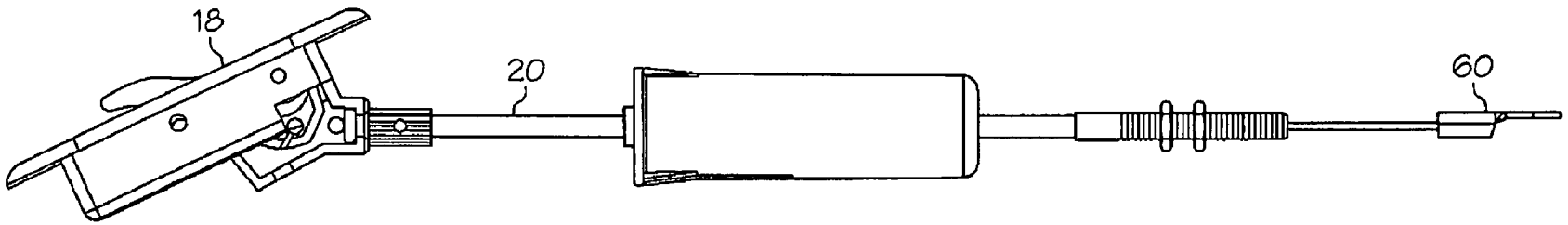

With reference to FIGS. 6A and 6B, views of the handle 18 and cable 20 assembly are shown. As shown in FIG. 6B, the handle may move upwardly and downwardly in order to activate the locking mechanism. Head connector 60 attaches to the locking mechanism to activate the pin stop 50.

Figure 7A:
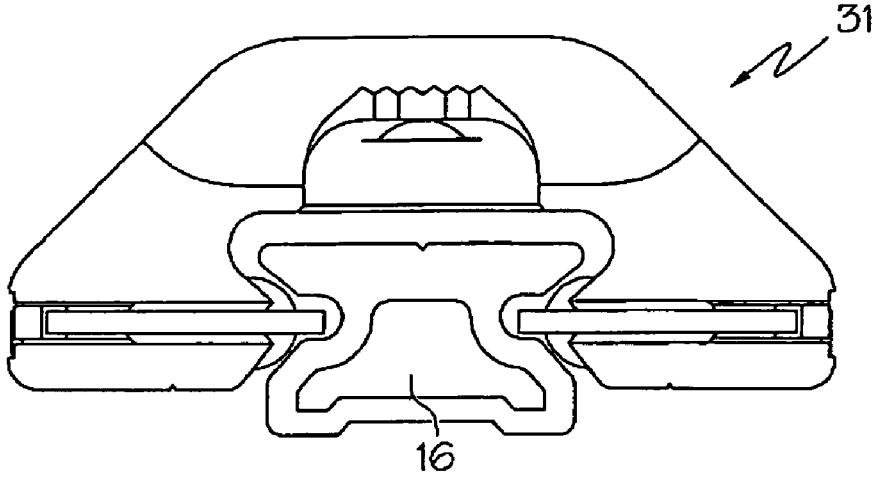
FIGS. 7A and 7B show the non-locking car slidingly secured over the track.
Figure 7B:
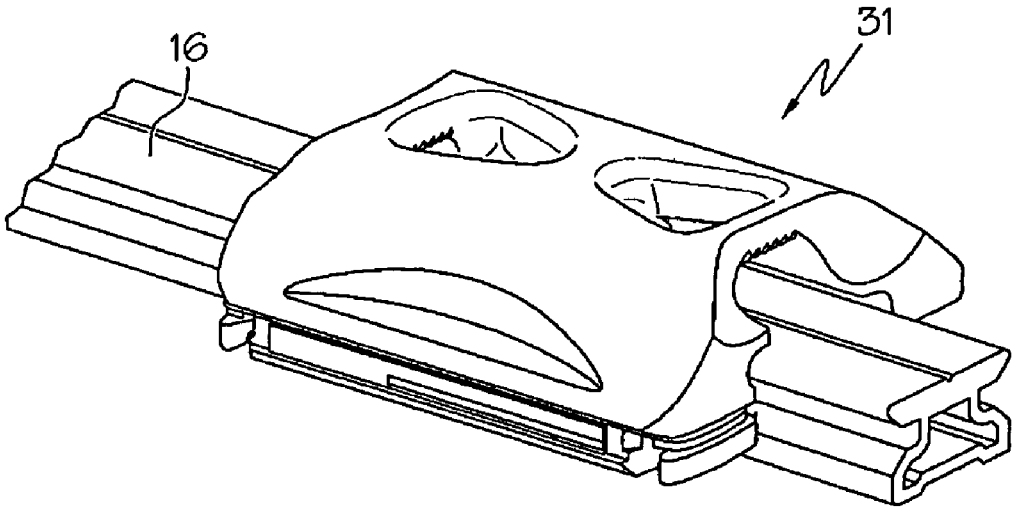

With reference to FIGS. 7A and 7B, the non-locking car 31 is shown slidingly secured over the track 16. FIG. 7A shows a cross sectional view of the car 31 around the track 16. FIG. 7B shows a perspective view of the car 31 around the track 16.

The above has been described and illustrated in exemplary form only, and modifications and alternatives will occur to those of ordinary skill in the art. All such designs are deemed to be within the inventive subject.

What is claimed is:

1. A seating assembly, said seating assembly comprising:
a curved track, said curved track having opposing sides defining angled channels;
a seat; and
a plurality of cars secured to the base of said seat;
each of said cars defining an internal section with opposing longitudinal sides, each of said longitudinal sides housing ball bearing assemblies;
said plurality of cars being slidingly secured to said curved track, said plurality of cars riding upon said curved track within said internal section, said opposing longitudinal side ball bearing assemblies in sliding engagement with said curved track angled channels.

2. The seating assembly described in claim 1 further comprising a locking mechanism;
said locking mechanism temporarily securing said car in a desired location on said curved track.

3. The seating assembly described in claim 2, wherein at least one said car comprises a pin stop, said pin stop being activated by said locking mechanism.

4. The seating assembly described in claim 3, wherein said locking mechanism comprising:
a handle, said handle secured onto said seat; and
a cable, said cable extending from said handle to said car pin stop.

5. The seating assembly described in claim 1 further comprising rolling support means mounted to the base of said seat.

6. The seating assembly described in claim 1, wherein said curved track is a 360 degree circle structure.

7. A seating assembly, said seating assembly comprising:
a curved track, said curved track having opposing sides defining angled channels;
a seat;
a plurality of cars secured to the base of said seat;
each of said cars defining an internal section with opposing longitudinal sides, each of said longitudinal sides housing ball bearing assemblies;
said plurality of cars being slidingly secured to said curved track, said plurality of cars riding upon said curved track within said internal section, said opposing longitudinal side ball bearing assemblies in sliding engagement with said curved track angled channels;
a locking mechanism;
said locking mechanism temporarily securing said car in a desired location on said curved track.

8. The seating assembly described in claim 7 further comprising rolling support means mounted to the base of said seat.

9. The seating assembly described in claim 8, wherein at least one said car comprises a pin stop, said pin stop being activated by said locking mechanism.

10. The seating assembly described in claim 9, wherein said locking mechanism comprising:
a handle, said handle secured onto said seat; and
a cable, said cable extending from said handle to said car pin stop.

11. The seating assembly described in claim 7, wherein said curved track is a 360 degree circle structure.

12. A seating assembly, said seating assembly comprising:
a curved track, said curved track having opposing sides defining angled channels;
said curved track is a 360 degree circle structure;
a seat;
a plurality of cars secured to the base of said seat;
each of said cars defining an internal section with opposing longitudinal sides, each of said longitudinal sides housing ball bearing assemblies;
said plurality of cars being slidingly secured to said curved track, said plurality of cars riding upon said curved track within said internal section, said opposing longitudinal side ball bearing assemblies in sliding engagement with said curved track angled channels;

a locking mechanism;

said locking mechanism comprising a handle secured to said seat and a cable extending from said handle to said pin stop;

said locking mechanism temporarily securing at least one said car in a desired location on said curved track;

a plurality of pin stops secured within said cars, said pin stops being activated by said locking mechanism; and rolling support means mounted to the base of said seat.

* * * * *